United States Patent [19]

Bonzo et al.

[11] 4,138,069

[45] Feb. 6, 1979

[54] WINDING APPARATUS FOR GLASS OPTICAL FILAMENTS

[75] Inventors: Roy T. Bonzo; Daniel H. Knowles, both of Painted Post, N.Y.

[73] Assignee: Corning Glass Works, Corning, N.Y.

[21] Appl. No.: 902,977

[22] Filed: May 4, 1978

[51] Int. Cl.[2] ..... B65H 54/02; B65H 67/04

[52] U.S. Cl. ..... 242/18 A; 242/18 PW; 242/19

[58] Field of Search ..... 242/18 A, 18 PW, 25 A, 242/125.1, 35.5 A, 19

[56] References Cited

U.S. PATENT DOCUMENTS

| | | | |
|---|---|---|---|
| 3,583,650 | 6/1971 | Zaborovsky | 242/18 A X |
| 3,625,451 | 12/1971 | Anderson | 242/18 PW X |
| 3,794,260 | 2/1974 | Sowell | 242/18 PW X |
| 3,809,326 | 5/1974 | Wust | 242/18 A X |
| 3,820,730 | 6/1974 | Endo et al. | 242/35.5 A X |
| 3,974,972 | 8/1976 | Egli et al. | 242/18 PW |
| 4,019,690 | 4/1977 | Peter et al. | 242/18 A |
| 4,033,519 | 7/1977 | Abe et al. | 242/18 A |
| 4,069,984 | 1/1978 | Klink et al. | 242/18 A X |

*Primary Examiner*—Stanley N. Gilreath
*Attorney, Agent, or Firm*—William J. Simmons, Jr.; Walter S. Zebrowski

[57] ABSTRACT

Disclosed is a method and apparatus for winding glass optical waveguide filaments during drawing thereof. When a spool is full, the apparatus automatically changes spools, attaches the filament being drawn to a spool moved into the winding station, and severs the filament from the full spool.

7 Claims, 10 Drawing Figures

WINDING APPARATUS FOR GLASS OPTICAL FILAMENTS

BACKGROUND OF THE INVENTION

This invention relates to a method of winding continuously formed filament, thread or the like on a plurality of spools, and more particularly, to a method of automatically changing spools, i.e., removing from the winding station a spool that is full, severing the filament from the full spool, and attaching the filament to an empty spool that has been moved into the winding station.

The present invention is particularly applicable to the winding of relatively fragile filaments such as glass optical waveguides. The characteristics of such optical waveguides and methods of making the same are disclosed in the publication "Doped-Deposited-Silica Fibres for Communications" by R. D. Maurer, Proc. IEE, Vol. 123, No. 6, June, 1976, pp. 581–585. Such filaments are manufactured by initially forming a glass preform from which filaments are drawn. Drawing speeds up to 2 meters per second have been achieved, and speeds up to 5 meters per second are anticipated in the near future. Up to 15 km of filament can be produced from a single glass blank, and the drawn filament is wound on spools containing as little as 25 meters per spool. After the desired length of filament is wound on a spool, it is very difficult if not impossible for an operator to change spools by hand when filament drawing speeds exceed one meter per second. An automatic apparatus for performing this function must be capable of removing a full spool from the winding station, attaching the filament to an empty spool and continuing to wind the filament without breaking it or causing damage thereto, without interrupting the drawing of the filament and without generating an undue amount of waste filament. Also, the filament ends should protrude from the spools to facilitate the connection of testing equipment thereto. Presently available equipment is incapable of meeting these requirements.

SUMMARY OF THE INVENTION

It is therefore an object of the present invention to provide a filament winding apparatus possessing the aforementioned desirable features.

Briefly the apparatus of the present invention comprises a rotatable turret plate having at least two rotatable spindles thereon, one of which is disposed in a winding station. Each of the spindles is adapted to support a cylindrical spool having a filament gripping means along at least one side thereof. Means is provided for guiding the filament across a central portion of the spool that is disposed in the winding station. Means is provided for moving the filament from the central portion of the spool which is disposed in the winding station to the filament gripping means on the side thereof. After a spool is full, the turret plate rotates that spool out of the winding station and replaces it with an empty spool. Means is provided for contacting the filament gripping means of the full spool after the filament has been moved to the gripping means at the side thereof, thereby causing the gripping means at the side thereof, thereby causing the gripping means to engage the filament. The contacting means thereafter contacts the filament gripping means of the empty spool that has been rotated into the winding station, thereby causing the gripping means of the empty spool to engage with the filament, whereby the filament extends between the full spool and the empty spool. That portion of the filament extending between the two spools is then severed.

DESCRIPTION OF THE PREFERRED EMBODIMENT

It is to be noted that the drawings are illustrative and symbolic of the present invention, and there is no intention to indicate the scale or relative proportions of the element shown therein. The present invention will be described in connection with the winding of optical waveguide filaments although this invention is not intended to be limited thereto.

Figure 1:
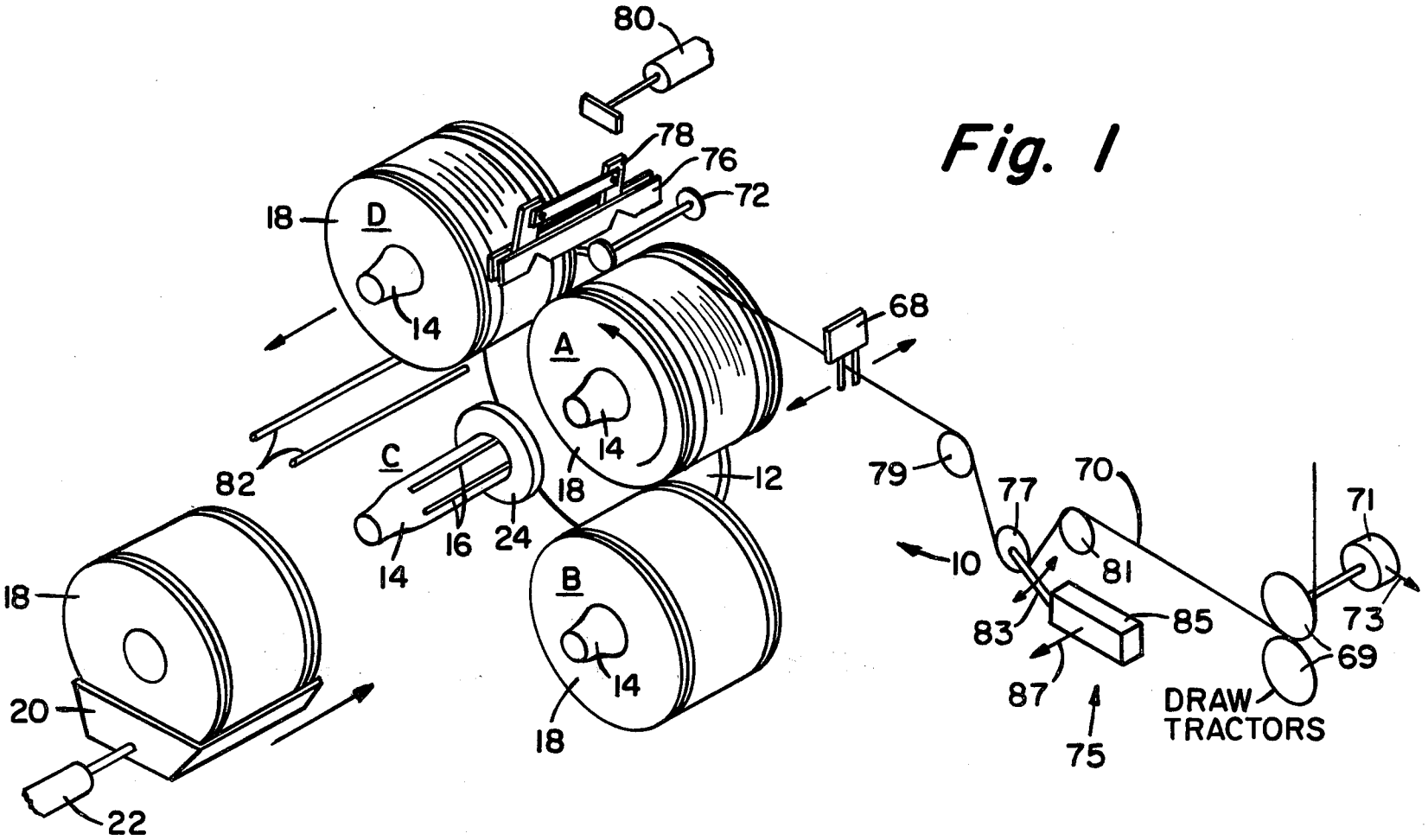
FIG. 1 is an oblique view of the winding apparatus of the present invention.

The winding apparatus shown in FIG. 1 is a vertical indexing turret winder 10 having four stations: wind station A, wait station B, load station C and unload station D. Winder 10 comprises turret plate 12, around the circumference of which are disposed equally spaced spindles 14. Splines 16, which are longitudinally disposed along the surface of spindles 14, function to firmly retain spools 18. To load a cylinder 18 on spindle 14, the spool is placed into loading container 20 which, at the proper time, is moved toward the spindle by means such as compressed air cylinder 22. Even though the opening in spool 18 is substantially aligned with the axis of spindle 14, the end of the spindle is tapered to facilitate the loading procedure. The spool is loaded onto spindle 14 until it contacts disc 24 which is affixed to and rotates with spindle 14. Splines 16 frictionally engage the spool to such an extent that it remains on the spindle after loading container 20 is retracted.

Figure 3:
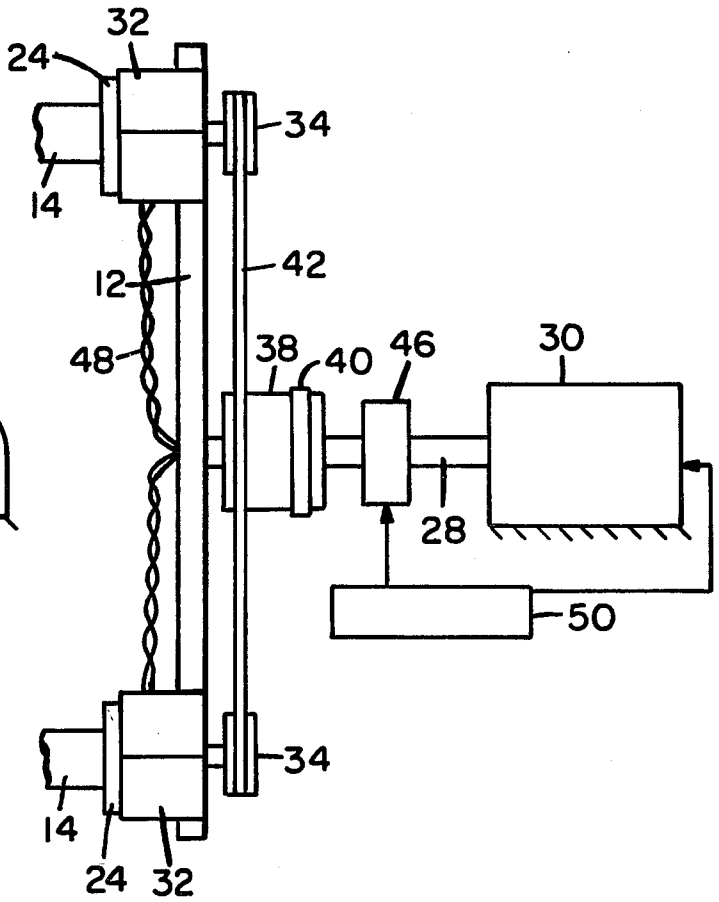
FIG. 3 is a schematic side elevational view of the turret plate.
Figure 2:
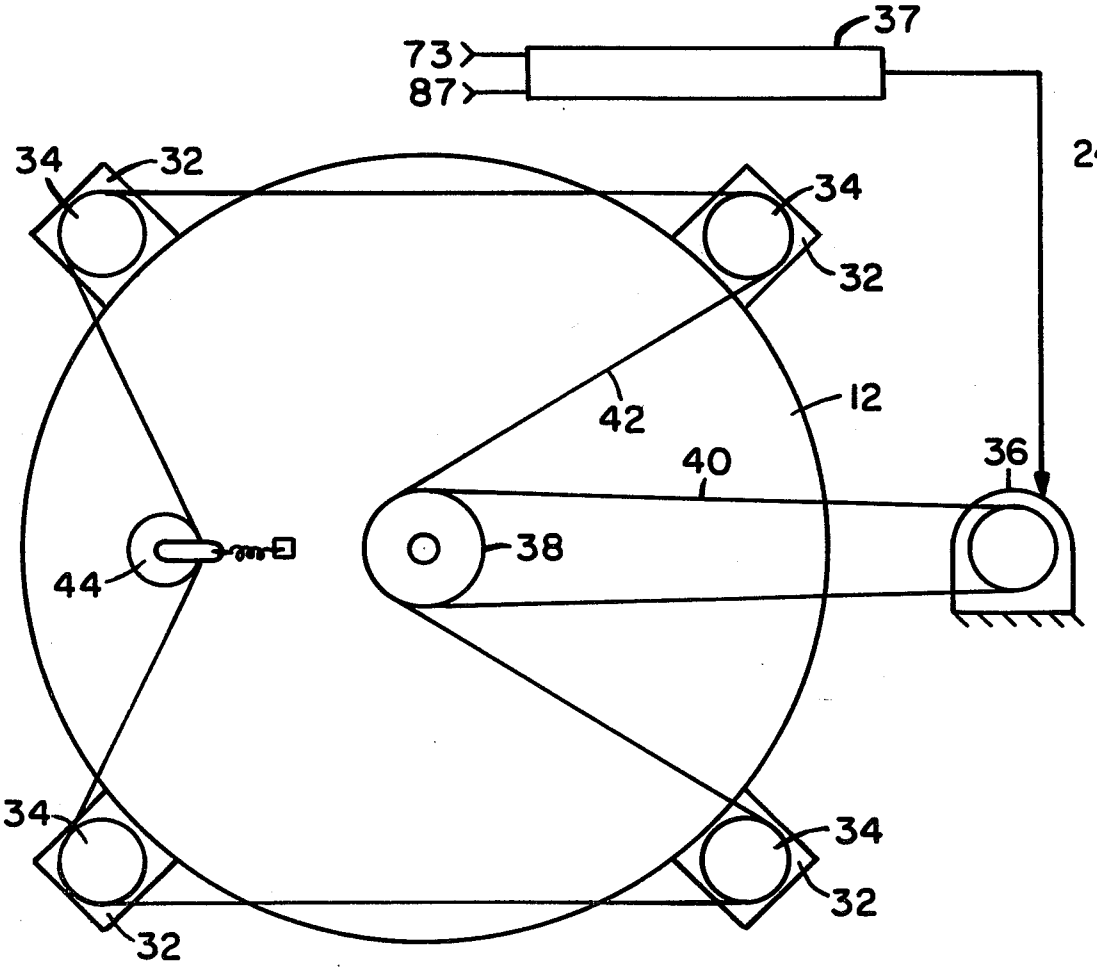
FIG. 2 is a rear elevational view of the turret plate.

The mechanism for indexing turret plate 12 and for rotating spindles 14 is illustrated in FIGS. 2 and 3. Turret plate 12 is mounted on a shaft 28 which is connected to indexer 30. The bearings for shaft 28 are not shown. A commercially available indexer, which is manufactured by the Ferguson Machine Company under trademark Para-Dex, can be programmed to index shaft 28 any given radial distance. In the present example, wherein four stations are employed, the indexer rotates shaft 28 a radial distance of 90° during each cycle. Since two or more stations may be employed, the extent of rotation per cycle is determined by dividing 360° by the number of stations employed. Clutches 32, which are affixed to the edge of turret plate 12, are driven by pulleys 34. Belt 40 connects motor 36 to drum 38 which is coaxial with shaft 28 and is free to rotate with respect thereto. The speed of motor 36 is controlled by a circuit, the inputs of which will be described hereinbelow.

Pulleys 34 are maintained in constant rotation by belt 42 which is disposed therearound and which also makes frictional contact with drum 38. Idler pulley 44 maintains the proper amount of tension on belt 42. A slip ring mechanism 46, which is connected to controller 50, provides clutches 32 with power by way of electrical leads 48, which pass through an aperture in plate 12 and through the tubular shaft 28 to the slip ring mechanism. Controller 50 is programmed so that spindles disposed at stations A and B of FIG. 1 are caused to continuously rotate at the winding speed in the direction of the arrow. As hereinafter described, the spindle in station D rotates during only portion of the cycle. For the sake of simplicity, elements 30 and 46 are not shown in FIG. 2 and motor 36 is not shown in FIG. 3.

Figure 4:
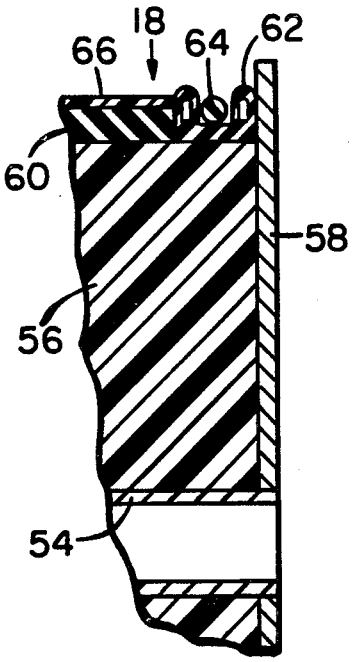
FIG. 4 is a partial cross-sectional view of a winding spool that may be employed in the present apparatus.

The construction of spools 18 is shown in the partial cross-sectional view of FIG. 4. Plastic tube 54 is disposed in an aperture extending through cylindrical styrofoam body 56, the ends of which are provided with plastic flanges 58. A foam rubber layer 60 is disposed around body 56 to cushion the filament. Layer 60 may be covered by a thin plastic layer 66. At each end of body 56 between flange 58 and layer 60 is disposed a hump rubber extrusion 62 having two humps, a rubber O-ring 64 being disposed between the two humps thereof. The region of contact between one of the humps 62 and O-ring 64 is referred to herein as the pinch line. A more detailed description of spools 18 can be found in copending U.S. Pat. Application Ser. No. 903,001 entitled "Spool for Filament Winder", R. T. Bonzo, filed on even date herewith.

Referring again to FIG. 1, a filament guide 68 is disposed between the winding reel that is positioned in station A and the filament draw tractors 69 which pull the filament from a source of molten glass. The draw tractors are powered by a motor 71. A control unit on the tractor motor provides an electrical signal that is indicative of the speed of that motor. The signal on lead 73 is coupled to the control circuit of FIG. 2 as the primary input thereto for determining the speed of winding motor 36. Disposed between the draw tractors and the winding reel of station A is a tensioning device 75 wherein filament 70 passes over pulleys 77, 79 and 81. Pulley 77 is rotatably mounted at an end of dancer arm 83 which is capable of pivoting as illustrated by the double-headed arrow. Arm 83 extends from apparatus 85 wherein a spring or other suitable means applies a constant force to arm 83 which urges pulley 77 away from pulleys 79 and 81. Located within apparatus 85 is a linear displacement transformer (LDT) which senses the position of dancer arm 83. As indicated by lead 87 the output signal from the LDT is coupled to control circuit 37 of FIG. 2 for trimming the speed of winding motor 36 so as to maintain dancer arm 83 in a central position.

Figure 5:
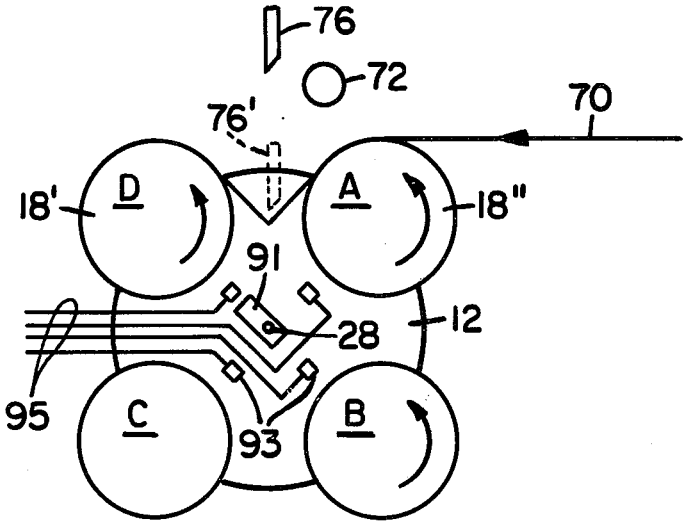
FIG. 5 is a diagrammatic illustration wherein a portion of the operation of the apparatus of the present invention is shown.

Pinch line rollers 72 are disposed vertically above the pinch lines at both ends of spool 18 at station A. As shown in FIG. 5, the axis of roller 72 is not necessarily in the same vertical plane as the axis of spool 18" of station A. A cut knife 76 includes a first blade having V-grooves, the bottoms of which are located in planes extending through the pinch lines of the spools of stations A and D. Thus, when a filament 70 extends between one of the pinch lines of the spool of station A and the corresponding pinch line of the spool of staion D, the filament extends directly beneath a corresponding V-groove of cut knife 76. The knife is so designed that it does not cut the filament on contact but can depress the filament as shown in FIG. 5 wherein the knife is diagrammatically represented. When the knife reaches the position illustrated by dashed lines 76' in FIG. 5, a pair of knife blades 78 (FIG. 1) are caused to move horizontally and cut the filament which is then located at the bottom of one of the V-grooves. When the cut knife reaches position 76' it also actuates a limit switch (not shown) the output of which is connected to controller 50. After the filament extending between the spools of stations A and D has been severed, the clutch at station D is deenergized, and the spool at that station is allowed to coast. Means such as air cylinder 80 is then actuated to push the spool of station D from spindle 14 onto a set of receiving rods 82 from which it can be manually or otherwise removed. The extent of movement of spool 18 from the spindle of station D is sufficient to permit the next fully wound spool from station A to be rotated into station D.

Also shown in FIG. 5 is a schematic diagram illustrating circuitry for informing controller 50 of the position of each of the spindles 14. A metallic flag 91 is mounted on shaft 28 and rotates therewith. Since this circuit is more readily illustrated in schematic form, it is not shown in FIG. 3. Four proximity sensors 93 are fixedly mounted and are so disposed that they are spaced 90° apart in angular orientation about the axis of shaft 38. The four leads 95 from sensors 93 are connected to controller 50. As flag 91 rotates to a position adjacent one of the sensors 93, the output signals on leads 95 are indicative of the orientation of flag 91.

Figure 6:
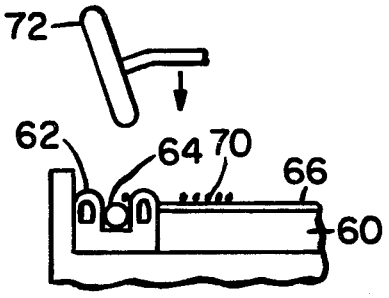
FIGS. 6–8 illustrate the capture of a filament by the gripping means at the side of the spool.
Figure 7:
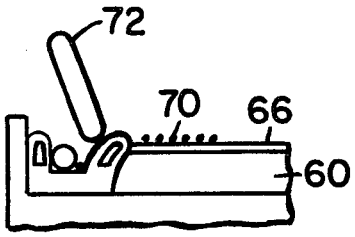
Figure 8:
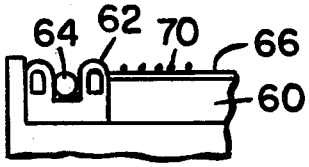

The manner in which a filament is caused to be gripped by means 62, 64 is illustrated in FIGS. 6–8. As shown in FIG. 6 filament 70 is guided from plastic layer 66 to the pinch line between a section of the hump rubber extrusion 62 and O-ring 64. The winding tension is insufficient to cause the filament to pass through the pinch line at the region of contact between members 62 and 64. While the spool is turning, roller 72 moves to the position shown in FIG. 7 and depresses the hump rubber away from the O-ring, thereby creating a gap into which the filament falls. The axis of roller 72 is preferably angularly oriented with respect to the axis of the spool as illustrated in FIGS. 6 and 7. Since the spool is turning, the gap is always forming and closing as the rubber hump passes under the roller. After the roller retracts, the gap remains closed. Rollers 72 preferably include a tire of soft material such as rubber so that they do not abrade the glass filament.

Figure 9:
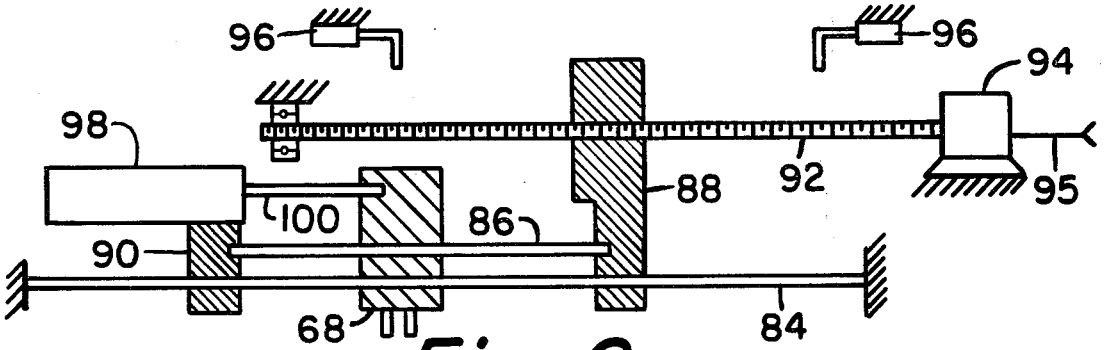
FIG. 9 is a cross-sectional view of a filament guide apparatus.
Figure 10:
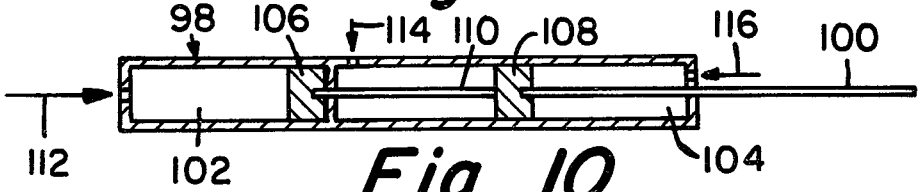
FIG. 10 is a schematic representation of an air cylinder for use in the apparatus of FIG. 9.

The mechanism for operating filament guide 68 is shown in FIGS. 9 and 10. Guide 68 is slidably mounted on rods 84 and 86. The ends of rod 84 are fixedly mounted in the overall winding apparatus, and the ends of rod 86 are secured to tracking member 88 and support member 90, both of which are slidably mounted on rod 84. A threaded shaft 92, which is rotated by motor 94, passes through a threaded bore in member 88. Motor 94 is connected by lead 95 to control circuit 37 which controls the speed and direction of this motor. Controller 50 gives control circuit 37 information regarding the direction and speed of motor 94. The speed of motor 94 is governed by the speed of motor 36 during the time that filament is being wound on the central portion of the spool. The system also includes feedback circuits (not shown) from each of the motors 36 and 94 to control circuit 37. Limit switches 96 are activated by member 88 to generate a signal when the winding limits of the spool are reached. This signal is coupled to controller 50 which de-energizes motor 94 and activates three-position air cylinder 98. Cylinder 98, which is mounted on support member 90, maintains guide 68 in the center of rod 86 during the winding of filament on the central portion of the spool. However, when a limit switch 96 has been activated, rod 100 of cylinder 98 is caused to rapidly move in the direction in which guide 68 has been traveling to cause filament 70 to jump to the pinch line groove at the end of the spool.

The operation of cylinder 98 is illustrated in FIG. 10. Cylinder 98 has two cylindrical chambers 102 and 104, in which there are disposed pistons 106 and 108, respectively. Rod 110, which is secured to piston 106, extends into compartment 104. Rod 100 is secured to piston 108. To maintain cylinder 98 in the winding position shown in FIG. 10, inputs 112 and 116 are activated, the pressure at input 112 being slightly greater than that at input 116. Thus, piston 106 is moved to the right, rod 110 butting against piston 108 and forcing it to the right. The lower input pressure at input 116 causes piston 108 to bear against the end of rod 110, thereby centering piston 108 in chamber 104. If the input pressure at input 112 ceases while that at input 116 remains, piston 108 moves to the left and forces piston 106 to the left end of chamber 102. Piston 108 is caused to move to the right end of chamber 104 by applying pressure only at input 114, inputs 112 and 116 remaining unpressurized.

Controller 50 is a Texas Instruments TI 1023 programmable controller together with its interfacing equipment. This controller receives signals from the cut knife limit switch, limit switches 96, and proximity switches 93. A limit switch (not shown) activated by dancer arm 83 provides an input to controller 50 when the dancer arm is at the bottom position which indicates that there is no filament under tension at pulley 77 to hold that arm in the up position. Limit switches (not shown) activated by air cylinders 22 and 80 provide signals to controller 50 to prevent indexing while the arms of these cylinders are extended. Controlled by controller 50 are the starting and stopping of the motor of indexer 30, the valves which operate the various air cylinders, the speed and direction of traverse motor 94 (via control circuit 37), and the operation of clutches 32, cut knife 78, and rollers 72.

The operation of the disclosed winding apparatus is as follows. With filament guide 68 in line with one of the end sections of the spool in station A, filament 70 is threaded through the filament guide and over the respective pinch line of the spool. The pinch line rollers are actuated so that a gap between members 62 and 64 is opened and the filament falls therethrough as illustrated in FIG. 7. As the gap closes, the filament is captured by the gripping means comprising members 62 and 64. Guide 68 then guides the filament to the winding section of the spool, and filament 70 is wound across layer 66. When the spool is full, guide 68 positions the filament in the pinch line at the opposite end of the spool. Turret plate 12 then indexes 90° causing the full spool from station A to be positioned at station D. During the indexing of the full spool from station A to station D, the rate of rotation of the full spool decreases due to the signal from apparatus 85, thereby maintaining a constant tension on the filament. As the full spool is being indexed to station D it rotates into contact with rollers 72. This momentarily opens a gap between members 62 and 64 causing the filament to be captured thereby. As an alternative method of operation rollers 72 can be positioned above the path of rotation of the full spool and can be lowered into contact with the full spool while it is still in station A.

As a full spool indexes out of the winding station, an empty spool indexes in, the filament being automatically positioned in the pinch line of the empty spool but traveling over it until the rollers open the gap. Since the spool in station B has been rotating at winding speed, there is no delay such as that which would be experienced if the spool had to be brought up to winding speed after it reached station A. In FIG. 5 the full and empty spools are represented by numerals 18' and 18'', respectively. With the indexing operation complete, rollers 72 descend and open the pinch line gap at the edge of spool 18'' to permit the filament to fall therein. Until the filament extending between spools 18' and 18'' is cut, it is continuously pulled out of the gripping means of spool 18'' and is wound around the gripping means of spool 18'. The cut knife then deflects downwardly the filament extending between spools 18' and 18''. This deflection of the filament increases the length of filament which is in the pinch line gap prior to cutting and makes the transfer of filament to spool 18'' more reliable. As soon as the filament is cut, it remains in the gripping means of spool 18''. The rollers can be retracted simultaneously with the cutting of the filament or just thereafter. Controller 50 (FIG. 3) de-energizes the clutch at station D about one second after the filament is cut, and the full spool is now free to be unloaded. Knife 76 then retracts. Guide 68 then moves the filament back onto the winding surface 60 of the newly started spool which begins to wind the filament.

We claim:

1. An apparatus for winding a filament comprising a rotatable turret plate having at least two rotatable spindles thereon, one of said spindles being disposed in a winding station, each of said spindles being adapted to support a cylindrical spool having filament gripping means at at least one side thereof, means for guiding said filament across a central portion of a spool that is disposed in said winding station, means for moving said filament from the central portion of a spool in said winding station to the filament gripping means on the side thereof, means for rotating said turrent plate to take a full spool out of said winding station and place an empty spool in said winding station, means for contacting the filament gripping means of said full spool after said filament has been moved to said gripping means thereby causing said gripping means to grip said filament, said means for contacting thereafter contactng the filament gripping means of the empty spool that has been rotated into said winding station, thereby causing the gripping means of said empty spool to grip said filament, whereby said filament extends between said full spool and said empty spool, and means for severing that portion of said filament extending between said empty and full spools.

2. An apparatus in accordance with claim 1 further comprising means for depressing the filament extending between said full spool and said empty spool.

3. An apparatus in accordance with claim 2 wherein said means for severing comprises a cut knife and wherein said means for depressing comprises grooves in said cut knife.

4. An apparatus in accordance with claim 2 further comprising means for rotating said full spool after it has been indexed out of said winding station until said filament has been severed, and means for ejecting said full spool after it ceases to rotate.

5. An apparatus in accordance with claim 4 wherein said rotatable turret plate has at least three rotatable spindles thereon, one of said spindles being adapted to support an empty spool that is to be indexed into said winding station, and means for rotating said empty spool prior to the time that it is indexed into said winding station.

6. An apparatus in accordance with claim 5 wherein said means for guiding said filament comprises a motor driven threaded shaft, a follower member having a threaded bore in which said threaded shaft is disposed, and a filament guide connected to said follower member.

7. An apparatus in accordance with claim 6 wherein said means for moving said filament comprises a three-position air cylinder having a cylindrical member connected to said follower member and a movable rod projecting from said cylindrical member, said rod being connected to said filament guide.

* * * * *